US009228382B2

(12) United States Patent
Rocchitelli

(10) Patent No.: US 9,228,382 B2
(45) Date of Patent: Jan. 5, 2016

(54) DEVICE FOR LOCKING THE PORTHOLE DOOR OF WASHING AND DRYING MACHINES

(71) Applicant: ELETTROTECNICA ROLD S.R.L., Nerviano (Milan) (IT)

(72) Inventor: Onofrio Rocchitelli, Nerviano (IT)

(73) Assignee: ELETTROTECNICA ROLD S.R.L., Nerviano (Milan) (IT)

( * ) Notice: Subject to any disclaimer, the term of this patent is extended or adjusted under 35 U.S.C. 154(b) by 0 days.

(21) Appl. No.: 13/928,685

(22) Filed: Jun. 27, 2013

(65) Prior Publication Data

US 2014/0097623 A1 Apr. 10, 2014

Related U.S. Application Data

(63) Continuation of application No. 12/805,197, filed on Jul. 16, 2010, now abandoned.

(30) Foreign Application Priority Data

Jul. 17, 2009 (EP) ..... 09425291

(51) Int. Cl.

| | |
|---|---|
| ***E05C 17/56*** | (2006.01) |
| ***E05C 1/08*** | (2006.01) |
| ***A47L 15/42*** | (2006.01) |
| ***D06F 37/42*** | (2006.01) |
| ***D06F 39/14*** | (2006.01) |

(52) U.S. Cl.

CPC ..... *E05C 1/08* (2013.01); *A47L 15/4259* (2013.01); *D06F 37/42* (2013.01); *D06F 39/14* (2013.01); *Y10T 292/1021* (2015.04); *Y10T 292/11* (2015.04)

(58) Field of Classification Search

CPC ..... E05C 19/16; E05C 19/166; E05C 1/08; E05B 65/006; E05B 65/0007

USPC ..... 292/251, 251.5, 1, 95, 99, 106, 137, 292/144, 146, DIG. 66, DIG. 69; 126/191, 126/197, 201; 134/56 D, 57 D, 58 D, 57 DL, 134/58 DL; 68/12.26

See application file for complete search history.

(56) References Cited

U.S. PATENT DOCUMENTS

| | | | | |
|---|---|---|---|---|
| 3,408,834 | A | 11/1968 | McMillan | |
| 3,504,511 | A | 4/1970 | Allen | |
| 3,617,957 | A * | 11/1971 | Brighenti | 337/77 |
| 3,759,075 | A | 9/1973 | Lipschutz | |
| 4,032,180 | A | 6/1977 | Pohl | |
| 4,262,945 | A * | 4/1981 | Paulson | 292/89 |
| 4,365,830 | A | 12/1982 | Paulson | |
| 4,623,179 | A | 11/1986 | Davis | |
| 4,932,707 | A * | 6/1990 | Ekstran | 292/341.17 |
| 5,002,322 | A | 3/1991 | Fukumoto | |
| 5,323,628 | A * | 6/1994 | Mori et al. | 68/12.26 |

(Continued)

*Primary Examiner* — Kristina Fulton
*Assistant Examiner* — Nathan Cumar
(74) *Attorney, Agent, or Firm* — Jacobson Holman, PLLC.

(57) ABSTRACT

An electromagnetic door locking device for a washing machine and similar, adapted to lock a sliding cursor (30) cooperating with the end of a hook mounted on the machine porthole door through a blocking pawl (12). The device comprises two preloaded parallel and mechanically separate metal strips (16, 17), accomplishing the closing and the opening of the power circuit and of the open/closed door circuit, respectively, and that are maintained in the open position by said pawl (12) and by an actuator (13) operated by said cursor (30), when said door is open. (FIG. 1).

5 Claims, 4 Drawing Sheets

(56) References Cited

U.S. PATENT DOCUMENTS

| | | | | |
|---|---|---|---|---|
| 5,823,017 | A | 10/1998 | Hapke | |
| 6,036,241 | A | 3/2000 | Ostdiek | |
| 6,082,787 | A * | 7/2000 | Chioffi et al. | 292/128 |
| 6,363,755 | B1 * | 4/2002 | Hapke et al. | 68/12.26 |
| 7,004,517 | B2 | 2/2006 | Vitry | |
| 7,415,851 | B2 * | 8/2008 | Lax et al. | 70/57.1 |
| 7,775,070 | B2 * | 8/2010 | Lim et al. | 68/12.26 |
| 2004/0160065 | A1 | 8/2004 | Stojc | |

* cited by examiner

DEVICE FOR LOCKING THE PORTHOLE DOOR OF WASHING AND DRYING MACHINES

TECHNICAL FIELD

The present invention concerns a device for locking the porthole door of washing machines and dryers.

The loading space of these appliances is closed by a water-tight porthole, provided with a hook to be locked by locking means mounted on the front panel of the machine. The means for locking the hook interacts with a safety device, known as "door lock device", the function of which is both to prevent the porthole opening after the machine has been started and to delay its opening under given conditions, e.g. for ensuring that the basket rotation inside the machine has stopped.

PRIOR ART

There are known machines in which the porthole hook is engaged by a sliding cursor cooperating with a locking pawl that is actuated by a machine safety device.

There are further known door locking devices that are electromechanically or electromagnetically controlled such as the one disclosed in Italian patent n. 1312456, which accomplishes the additional function of preventing a start of the machine when the porthole door is open.

In the electromagnetically controlled door locking devices, the open or closed condition of the washing machine door is detected through the reading of a resistance value in a circuit comprising a serially connected switch, hereinbelow called open-closed door switch. Such a switch is indirectly closed by the hook of the porthole door when this latter is brought into the closed position.

The devices of this type are controlled by an electromagnet that, in response to predetermined numbers of pulses, either closes or opens a power circuit and simultaneously accomplishes either the mechanical blocking or unblocking of the safety device, i.e. enables or disables the door locking pawl. Only when the above mentioned switch is closed, and therefore only when the porthole door of the machine is in the closed position, the solenoid of the electromagnet is fed and as a consequence the starting of the machine is allowed.

In the known devices the presence of contact bounce (chatter) of the movable contacts have been reported which can create disturbances to the machine control electronics.

It is an object of the present invention to provide an electromagnetic door locking device for washing machines and the like that prevents the starting of the machine when the porthole door is open and that overcomes the limitations and the drawbacks of the prior art devices by preventing the onset of signal disturbances.

It is a further object of the invention to realize an open-closed door contact providing for different switching behaviours when the device is in a blocking position or in a non-activated condition.

According to the present invention these objects are achieved through a device for locking the porthole door as claimed in claim 1. Further advantageous characteristics are recited in the dependent claims.

The device according to the invention comprises a contact strip formed by two parallel and mechanically separate arms that allows to prevent the negative effects deriving from possible electrical interferences between the contacts caused by the motion of one of them, thus ensuring a "clean" signal.

Moreover, still according to the invention, when the device is not active, the differential between the closing and opening points of the strip of the open-closed door switch is positioned before the theoretical blocking point. On the other hand when the device is in a blocking position, the opening point is moved beyond the blocking point. In this way, also in case an incorrect traction is applied to the porthole door, the opening of the open-closed door contact is prevented.

Finally the device according to the invention will advantageously provide a large lifting force of the pawl blocking the cursor, although using a solenoid with a low traction force of the core, thus reducing the manufacturing cost.

BRIEF DESCRIPTION OF THE DRAWINGS

The invention will now be disclosed with reference to the attached drawings that illustrate a preferred but not limiting embodiment of the invention, in which.

DESCRIPTION OF A PREFERRED EMBODIMENT

Figure 1:
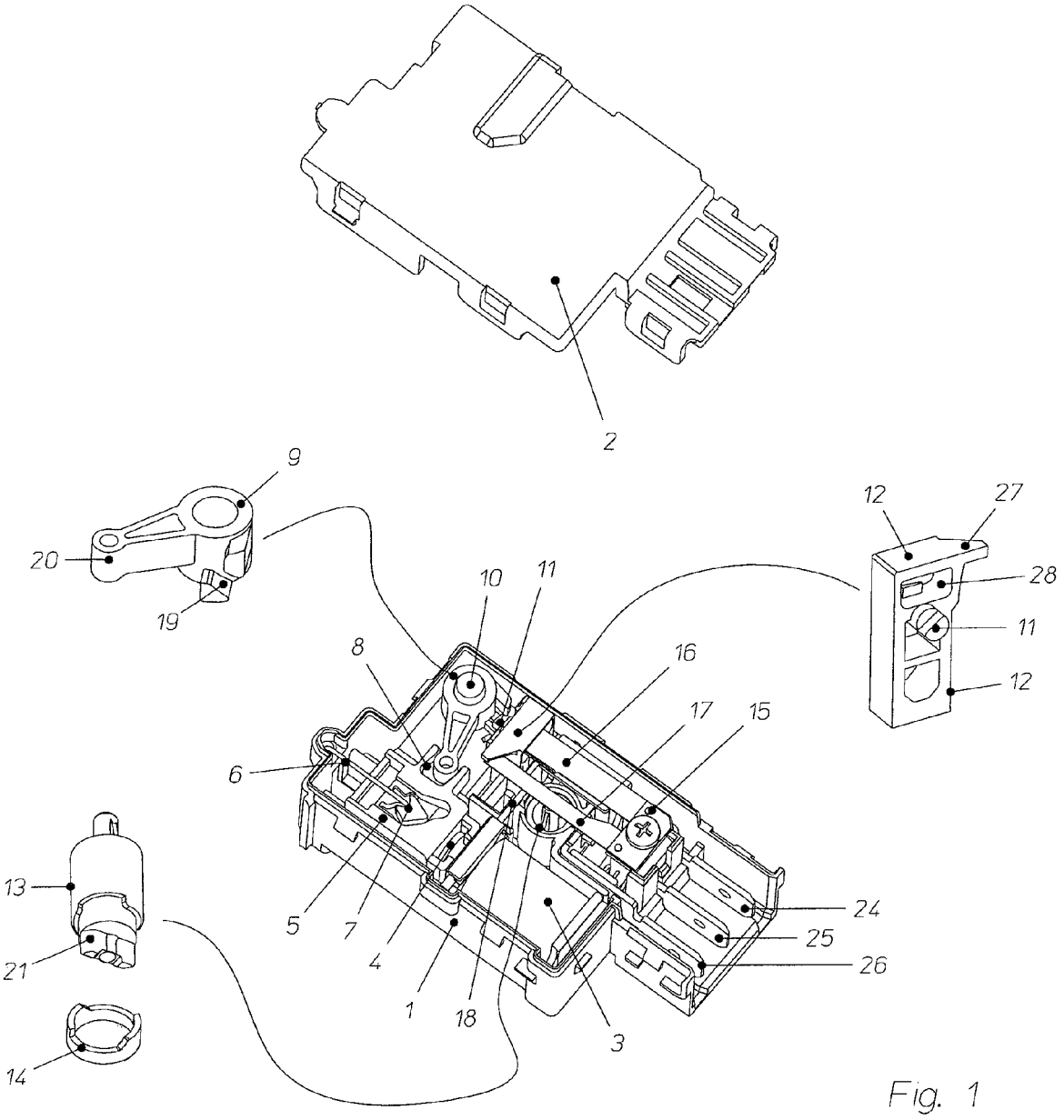
FIG. 1 is an axonometric view, with some exploded details, showing an embodiment of a door locking device according to the invention.
Figure 3:
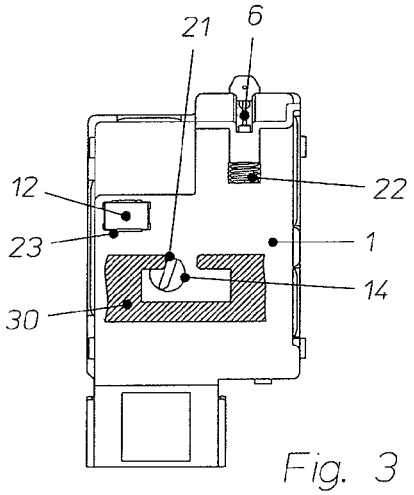
FIG. 3 is a bottom view of the device and of the cursor for engaging the door hook, shown in an open position of the contact-door.

With reference to FIGS. 1 and 3, a device according to the invention comprises a containment body 1, preferably made of a thermoplastic material, closed by a cover 2 through snap securing members or other suitable means.

Figure 4:
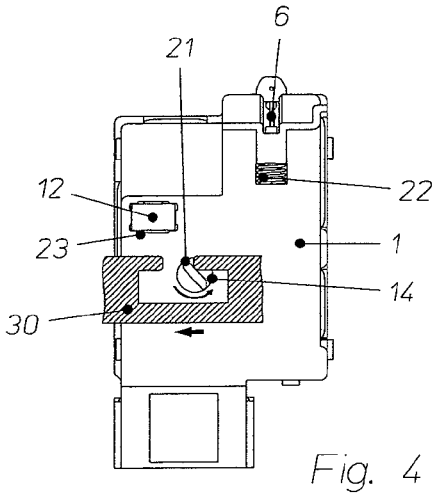
FIG. 4 is a bottom view of the device and of the cursor for engaging the door hook, shown in a closed position of the contact-door.

The body of the device is provided with known means for being mounted on the front panel of a washing machine together with a sliding cursor 30, only partially shown in FIGS. 3 and 4, accomplishing the function of engaging the hook of the porthole door (not shown in Figures) in the closed position.

The device further comprises an electromagnet 3, equipped with a pin 18, whose core 4 is secured to a sliding member or slide 5. The slide 5 is housed within the body 1 under the action of a helical spring 22, or similar elastic means, and is constrained by a "hooking" and "releasing" mechanism made up, in a known manner, by a wire spring 6 having one end secured to the body 1 and the opposite end engaging the shaped profile of a front cam 7 formed on the slide.

Figure 5:
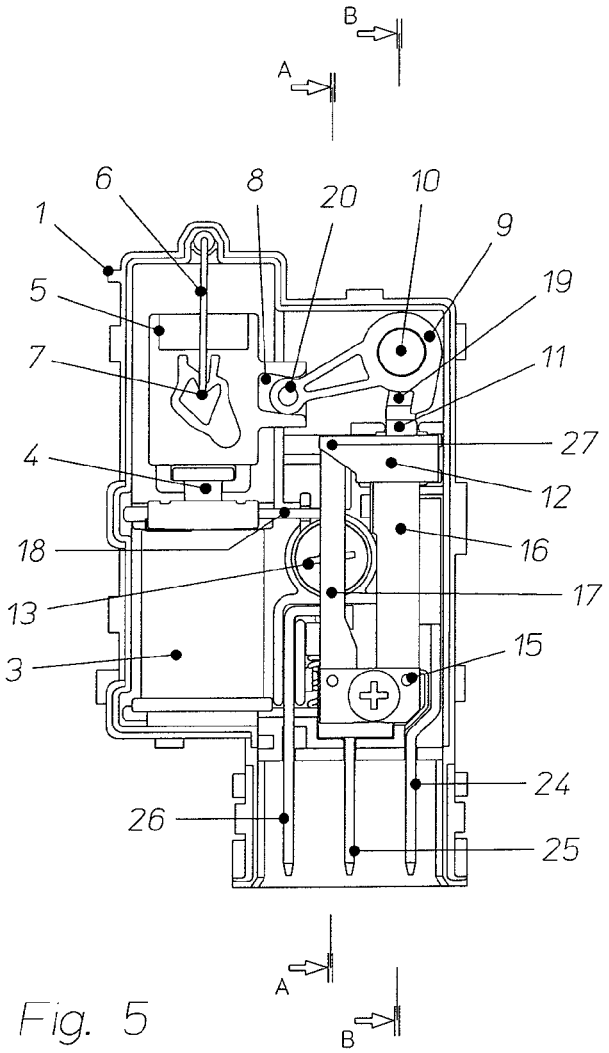
FIG. 5 is a top view of the device in the closed porthole door position with the device actuated.
Figure 6:
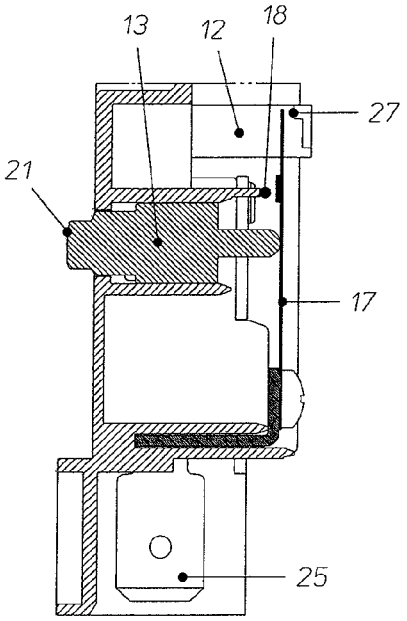
FIG. 6 is a cross section view along line A-A of FIG. 5.
Figure 7:
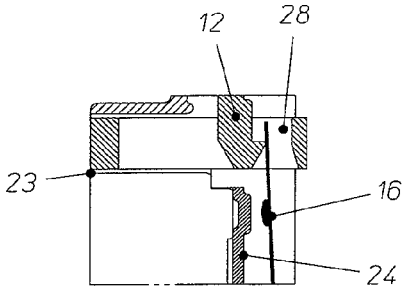
FIG. 7 is a partial cross section view along line B-B of FIG. 5.
Figure 8:
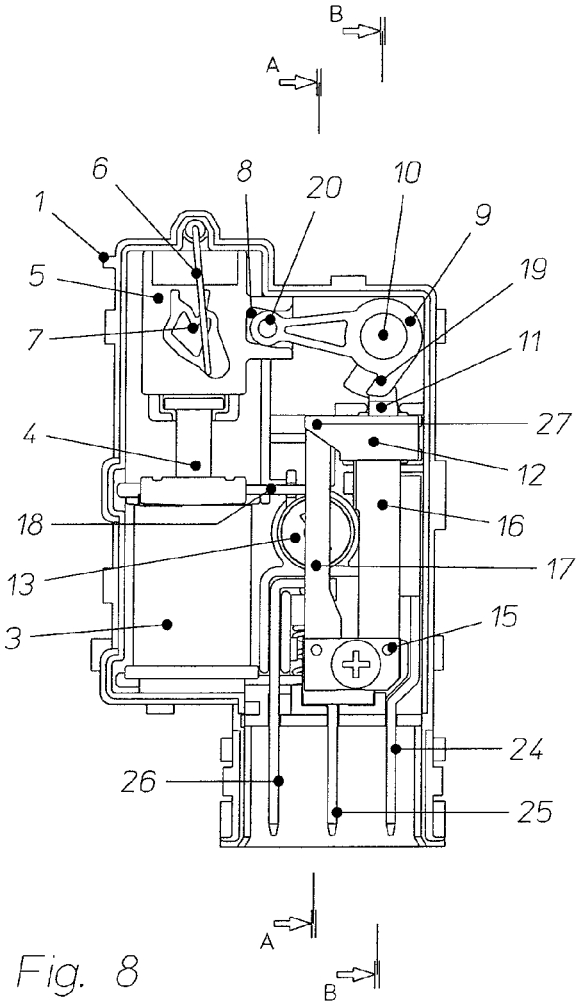
FIG. 8 is a top view from of the device in the closed porthole door position with the device actuated.

The cam 7 is so shaped as to provide a retaining or hooking position, as shown in FIGS. 1 and 5, in which the slide 5 is retained by the spring 6 against the elastic means 22, and a released position, as shown in FIG. 8. If required, the cam 7 can also provide two or more hooking positions.

A lever 9, pivotable around a pivot pin 10 formed in the body 1, is shaped so as to have two teeth or projections 19 adapted to engage a tooth 11 projecting from a pawl 12. The opposite end 20 of the lever 9 is constrained in a seat 8 suitably located on the slide 5.

The pawl 12 is housed in the body 1 in correspondence of an opening 23, formed in the body base, so that it can slide outside of the containment body, for engaging the sliding cursor 30 in a position retaining the porthole hook as partially shown in FIGS. 3 and 4.

The device further comprises a metal strip 15, formed by two parallel and mechanically separate arms 16 and 17, preferably obtained from a single shaped sheet metal. This way the closings of the two contacts are mechanically independent from one another so as to prevent any mutual interaction that could cause contact bounce and a pure or clean electric signal is ensured.

The first contact 16 accomplishes the closing/opening of the power circuit, whereas the second contact 17 is the open-closed door contact, and allows the feeding of the whole door locking device. The two arms are preloaded so as to realize the closed position of the contact.

The free end of contact 16 is fitted in a groove 28 formed in the pawl 12 that maintains the contact strip 16 in the open position when the device is in a rest condition. The pawl 12 further provides for a projection 27 located over the free end of the contact strip 17.

The door contact strip 17 is subjected to the action of a plastic actuator 13 that maintains the strip raised in an open position when the porthole is open.

The actuator 13 cooperates with a cylindrical cam 14, formed in the body 1, and has a shaped base 21 projecting from the base of the containment body in correspondence of a shaped seat formed in the sliding cursor 30, for causing the rotation of this latter.

The operation of the device is as follows.

When the porthole door is open, the device is as shown in FIGS. 3, 5, 6 and 7.

The strips 16 and 17 are respectively maintained in an open position by the pawl 12—which in turn is maintained in a retracted position with respect to the cursor 30 by the lever 9—and by the actuator 13, also maintained in a raised position by the cylindrical cam 14.

Figure 2:
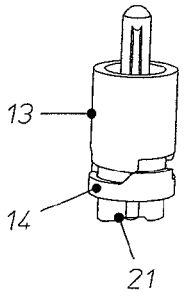
FIG. 2 is a side view of the actuator.

When the door is closed, the porthole hook is inserted into the seat provided on the machine panel and causes the cursor 30 to be translated for striking the projecting base 21 of the actuator 13 and rotating it as illustrated in FIGS. 3 and 4. The actuator 13 rotates over the cylindrical cam 14, as shown in FIG. 2, until it reaches a portion of the cam profile that causes its translation under the action of the load of the contact strip 17, with this latter closing the circuit by cross resting over the pin 18 of the electromagnet 3.

The system provides that the lowering of the actuator 13 causes its release from the strip 17, thus almost completely debouncing the device.

The solenoid 3 is then fed to operate the blocking pawl 12.

Namely, in response to the received pulse, the core 4 instantly attracts the slide 5 and therefore the cam 7 that is brought into the retaining position shown in FIG. 8 and in turn causes the rotation of the lever 9. As a consequence, the pawl 12 is engaged by the teeth 19 of the lever 9 thanks to the tooth 11, and is moved downwardly coming out of the body of the device in the blocking position of the cursor 30.

The translation movement of the pawl 12 releases the preloaded power contact 16, and this latter reaches the closed position thus closing the electric circuit between the terminals 24 and 25.

The retaining and releasing system of the cam 7 is designed as a known cinematic mechanism that allows the blocking-unblocking operations even in correspondence of a larger number of command pulses.

At the end of the operating cycle, a pulse is applied to the solenoid 3 and causes—through the cinematic mechanism formed by the arrangement of the core 4, the slide 5 and the lever 9—the return of the pawl 12 that releases the cursor 30 and allows for its sliding, operated by the hook of the porthole in the opening position.

At the same time the cursor 30, acting onto the base 21 of the actuator 13, causes a rotation-translation movement of this latter, over the cam 14, thus raising the arm 17 of the strip 15, and returning the contact to the opening position.

This way, by modifying the shape of the interacting profile between the actuator 13 and the cursor 30, the points at which a switch-on and switch-off is accomplished can be adjusted as desired in order to determine the run length or stroke required for closing and opening the contact.

The device further provides that, when the power contact 16 is closed, a further effect is achieved on the dynamics of the door contact 17 so as to obtain a different differential.

Namely, when the power contact 17 is closed as a result of the rotation of the lever 9 since this latter releases the pawl 12 and allows for its translation thanks to the preloaded strip 17, the device provides that—with a given profile—the teeth 19 of the lever 9 further press the pawl 12 in the final part of its translation.

Figure 10:
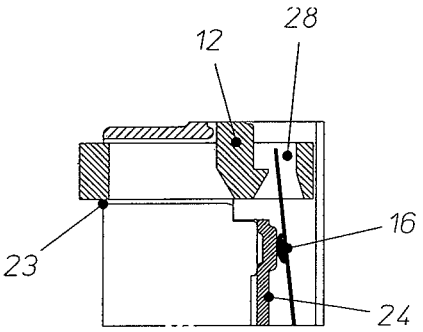
FIG. 10 is a partial cross section view along line B-B of FIG. 8.

As shown in FIG. 10, this additional preloading doesn't have a dynamic effect on the power strip 16 (and therefore on contact bouncing) since a safety spacing remains between the strip and the walls of the groove 28 of the pawl 12 in which it is inserted, which spacing being enough to almost completely eliminate the switch bounce.

Figure 9:
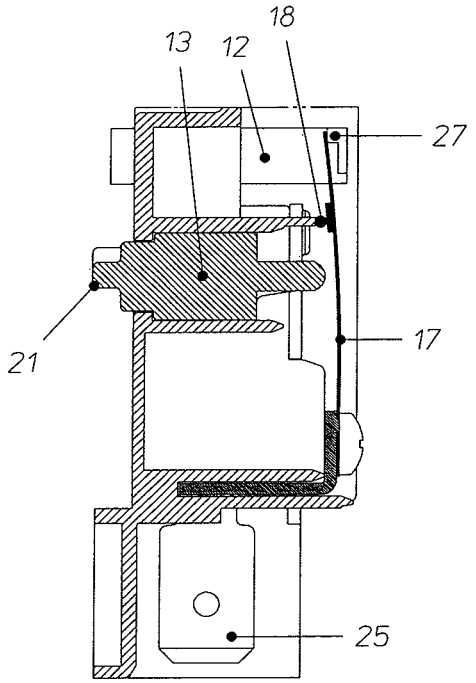
FIG. 9 is a cross section view along line A-A of FIG. 8.

The further run of the pawl 12 causes a bending of the door contact strip 17, through the projection 27, as shown in FIG. 9. This bending in enough to increase the switch off differential. With such an arrangement therefore, a rotation-translation of the actuator 13 could not cause the opening of the contact 17 when a traction is applied to the porthole door. This way the system reaches a block position before the opening of the door contact is allowed.

Advantageously the door contact 17 can be realized as a cross between the pin 18 and a conductive wire welded on the strip arm 17.

A door locking device as described above can be manufactured to comply with rast5 or rast2,5 standards and be equipped with a PTC for protecting the winding.

The invention has been illustrated with reference to preferred embodiments thereof, but it is generally susceptible of other applications and changes that fall within the scope of the invention as will become evident to the skilled of the art.

The invention claimed is:

1. An electromagnetic door locking device for a washing machine, having a containment body, said device comprising:

an electromagnet adapted to operate a blocking pawl of a sliding cursor, a power contact strip accomplishing closing and opening of a power circuit of the machine, a door contact strip which detects closure of a door, the blocking pawl of the sliding cursor for blocking and releasing a machine door closing hook and for accomplishing the closing and the opening of the power contact strip, an actuator accomplishing the closing and the opening of the door contact strip, wherein said power and door contact strips are mechanically separate and arranged side by side, wherein said blocking pawl provides for a projection located in correspondence of a free end of the door contact strip for compressing and bending said door contact strip when the door is closed and the pawl is activated, and wherein said pawl is operated by a mechanism formed by a lever pivotable around a pivot pin, which in turn is connected to a slide subjected to the action of elastic means, and actuated by a core of said electromagnet and constrained by a hooking and releasing mechanism.

2. The locking device as claimed in claim 1, wherein said hooking and releasing mechanism comprises a wire spring having one end connected. to said body and the opposite end engaging the shaped profile of a front cam formed on said slide.

3. The locking device as claimed in claim 1, wherein said lever has shaped teeth for applying a pressure onto said pawl for releasing said pawl from one of said strips and bending the other strip.

4. The locking device as claimed in claim 3, wherein said cam is formed so as to provide one or more engagement or hook positions.

5. The locking device as claimed in claim 1, wherein said actuator, accomplishing the closing and the opening of the door contact strip, that cooperates with a cylindrical cam, has a shaped base projecting from said body in correspondence of a shaped portion of said sliding cursor causing the rotation of said actuator over the cam profile.

* * * * *